US007340802B2

(12) United States Patent
Isbell

(10) Patent No.: US 7,340,802 B2
(45) Date of Patent: Mar. 11, 2008

(54) COTTONSEED DELINTER

(75) Inventor: Darrell Isbell, Richmond Hill, GA (US)

(73) Assignee: Carver, Inc., Savannah, GA (US)

( * ) Notice: Subject to any disclaimer, the term of this patent is extended or adjusted under 35 U.S.C. 154(b) by 387 days.

(21) Appl. No.: 11/121,699

(22) Filed: May 4, 2005

(65) Prior Publication Data

US 2006/0248685 A1 Nov. 9, 2006

(51) Int. Cl.
*D01B 1/08* (2006.01)

(52) U.S. Cl. ..... 19/41; 19/55 R

(58) Field of Classification Search ..... 19/40–47, 19/55 R, 57, 58
See application file for complete search history.

(56) References Cited

U.S. PATENT DOCUMENTS

| | | | | |
|---|---|---|---|---|
| 732,869 | A | 7/1903 | Larson | |
| 848,611 | A | 3/1907 | Casebolt | |
| 1,089,318 | A | 3/1914 | Camp | |
| 1,380,677 | A | 6/1921 | Pool | |
| 1,401,439 | A | 12/1921 | Pettit | |
| 1,426,687 | A | 8/1922 | Vardell | |
| 2,224,272 | A | 3/1940 | Myers et al. | |
| 2,310,598 | A | 2/1943 | Ricker | |
| 2,318,737 | A | 5/1943 | Blaylock | |
| 2,328,126 | A | 8/1943 | Carr et al. | |
| RE22,542 | E | 9/1944 | Ricker | |
| 2,655,695 | A | 10/1953 | Ford | |
| 2,736,068 | A | 2/1956 | Lopez | |
| 2,738,553 | A | 3/1956 | Davis, Jr. | |
| 3,919,742 | A | 11/1975 | Arifov et al. | |
| 4,102,017 | A | 7/1978 | Foerster | |
| 4,208,766 | A * | 6/1980 | Richardson | 19/64.5 |
| 4,262,390 | A | 4/1981 | Einglett et al. | |
| 4,699,049 | A | 10/1987 | Mizer | |
| 4,723,342 | A | 2/1988 | Strother et al. | |
| 4,942,643 | A * | 7/1990 | Kincer et al. | 19/44 |
| 4,967,448 | A | 11/1990 | Mizer | |

* cited by examiner

*Primary Examiner*—Shaun R. Hurley
(74) *Attorney, Agent, or Firm*—Smith, Gambrell & Russell

(57) ABSTRACT

A delinter apparatus for seed cotton includes a jack screw displacement system for a gratefall which opens the apparatus for removal of a saw cylinder while urging a plurality of belt tensioning idlers into a relaxed position such that the drive belt for the saw cylinder can be removed in a simplified and more efficient manner. The apparatus also has improved flow characteristics due to improvements in the lint feeder design as well as the transition designs from the feeder to the float chamber and saw interface.

13 Claims, 5 Drawing Sheets

COTTONSEED DELINTER

BACKGROUND OF THE INVENTION

The present invention relates to the field of cottonseed processing and more particularly to delinting cottonseed after it has been ginned and before the seed is itself processed to recover oil and other useful byproducts. In greater particularity the present invention relates to improvements in both the efficiency of the delinter and ease of maintenance of the delinter by the operators.

The present invention is an improvement over the delinting apparatus disclosed in U.S. Pat. No. 4,967,448 which is the closest prior art. The '448 patent discloses the basic delinting process and components used in a delinter and its disclosure is incorporated herein by reference in its entirety. As noted in the '448 patent, unprocessed cotton brought from the field to a cotton gin for ginning will produce bales of long cotton fibers while the remaining cottonseed will have a residue of lint thereon. Cottonseed processing apparatus has long been used to remove residue lint from cottonseeds which have already been processed in conventional cotton gins to remove the long, staple fibers from the seeds. The lint removed from the cottonseed is one of the salable products procured from the cotton operation.

Lint is removed in a single pass, called mill run cut lint, or multiple passes through a cottonseed processing apparatus known as a delinter. In multiple pass processes, the first pass lint yields high quality cellulose, used in manufacturing high quality paper. Lint from the second and third passes or mill run cut lint is usually sold in blended form, with munitions lint, hygienic cottonballs and various cellulose based chemicals being common end uses.

It is also desirable to delint seeds to enhance processability for oil extraction. In oil extraction apparatus, lint is a contaminant which detracts from the overall quality of the oil and adds to the maintenance requirements for the oil extraction apparatus.

In the conventional delinter, the lint is continuously removed from seed by subjecting a rotating mass of seed or "seed roll" to a rotating, ganged cylinder of toothed saw blades passing between ribs in a "grate". The lint is "doffed" from the saw teeth by a revolving brush cylinder.

The seed roll is rotated in a "float chamber" where the seed roll is subjected to the saws. Rotation of the seed roll is caused by a rotating paddle wheel "float" in the center of the seed roll. The density of the seed roll in the float chamber is controlled by a feedback controlled paddle wheel roll feeder upstream of the float. The rotating speed of the roll feeder is determined by the amperage required by the saw cylinder motor, such that seed roll density is maintained at an optimum level for efficient delinting. Typically, however the width of the feeder has been narrower than the width of the saw cylinder, and cottonseed was required to migrate to the ends of the cylinder in an attempt to process the seed through the saw. Rather than flowing smoothly this lateral migration created flow problems as the cottonseed tended to accumulate at the ends of the saw cylinder, resulting in split seeds with a consequent release of oil onto the lint and increased hull content in the lint discharged at both ends of the saw cylinder. Thus, recent delinters such as shown in the '448 patent, which were more energy efficient suffered from decreased quality of lint when operated at energy saving rates.

Machines used for delinting cottonseed are not to be confused with cotton gins which remove the staple fiber from the seed. Delinting apparatus use the seed cotton which has already been ginned and must be further processed to remove the residual lint from the seed. These machines operate year round rather than seasonally when the cotton is harvested and ginned. In use, the saw cylinders wear rapidly and require frequent sharpening, so a convenient means of accessing and removing the saw cylinder is required. Although the '448 patent greatly improved the access of the operator to the saw cylinder, machines built since that disclosure have suffered from significant drawbacks in operator ease of maintenance. Specifically, the prior machines have required multiple steps to remove the saw cylinder for sharpening, an event that occurs as frequently as daily over the operational life of the machine. For example, each time the saw was removed, the operator had to first loosen the tension on the drive belts from the saw motor and the float motor, then remove the belts, which required that he reach across the ends of the spindle of the saw cylinder and float cylinder and across the discharge augers, then open the gratefall with a fluid actuated cylinder sufficiently to hoist the saw cylinder out of the apparatus. No provision was made to break the circuit to the saw motor other than the on/off switch and the hydraulic cylinders used to open the gratefall had no backup to prevent uncontrolled pivoting of the gratefall during the opening process in case of a hydraulic failure. Thus, the prior system, while an improvement over earlier models was still cumbersome and dangerous.

The value or price of lint is determined by the purity of the lint fiber. The higher the foreign matter or "trash" such as broken hulls, kernels, etc. in the lint, the lower the quality. Therefore it is desirable to remove such trash from the lint in the delinter. "Moting", the removal of trash ("motes") from the lint, is accomplished by gravity in a moting chamber, where the heavier or more dense motes fall through an upwardly-flowing airstream created pneumatically to carry away the lint. As noted above, the value of both the seed and the lint is diminished if the seed spends too much time on the saw or is too compressed at the end of the saw cylinder such that the seed hull is torn.

Thus, it can be seen that conventional delinting apparatus currently in use suffers from a number of significant drawbacks. A need presently exists for eliminating these drawbacks, to yield delinting machinery which enables higher efficiency delinting and better quality lint than has previously been obtained.

SUMMARY OF THE PRESENT INVENTION

It is an object of the present invention to increase the capacity of the delinter over prior delinter designs while lowering energy consumption per ton of seed. Another object of the invention is to reduce the need to re-sharpen saws resulting in both longer saw life and saw sharpening file life. Still another object of the invention is decrease the amount of down time while re-sharpening each saw cylinder. A further object of the invention is to improve the quality of the lint. Yet another object of the invention is to reduce seed damage in the delinter. A significant object of the invention is to eliminate hydraulic and pneumatic cylinders in the gratefall operation to simplify and enhance the safety of the saw removal process.

These and other objects and advantages of the invention will become apparent from the following detailed description of the preferred embodiment of the invention.

BRIEF DESCRIPTION OF THE DRAWINGS

An apparatus for delinting cottonseed is depicted in the accompanying drawings which form a portion of this disclosure and wherein.

DESCRIPTION OF THE PREFERRED EMBODIMENT

Figure 2:
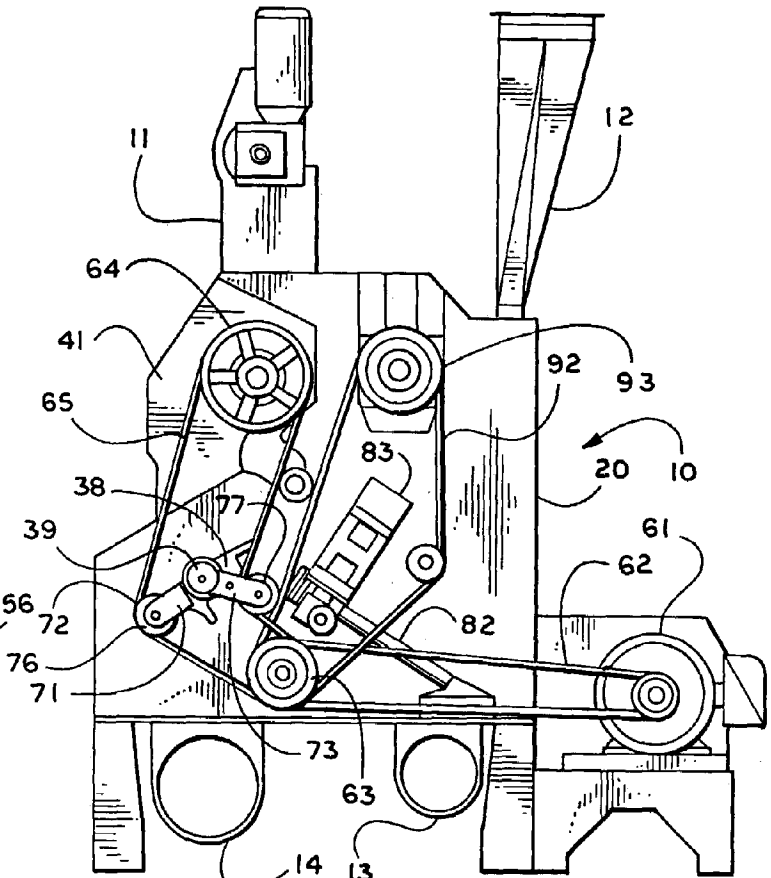
FIG. 2 is a side elevation view of the opposite side of the delinter showing the drive components for the float and doffing brush.
Figure 1:
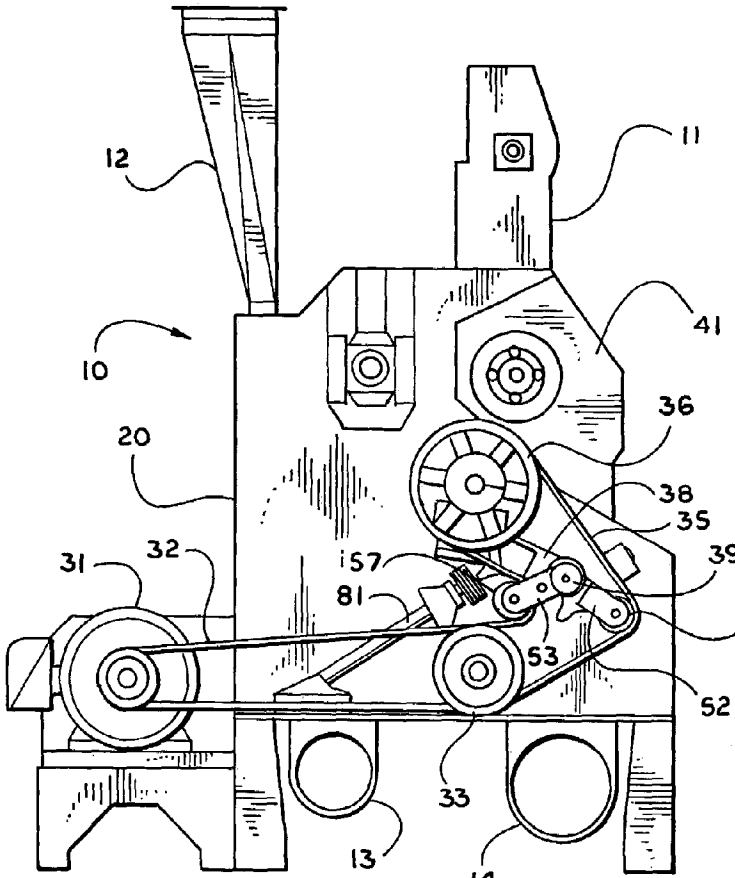
FIG. 1 is a side elevation view of the delinter showing the drive components for the saw cylinder.
Figure 3:
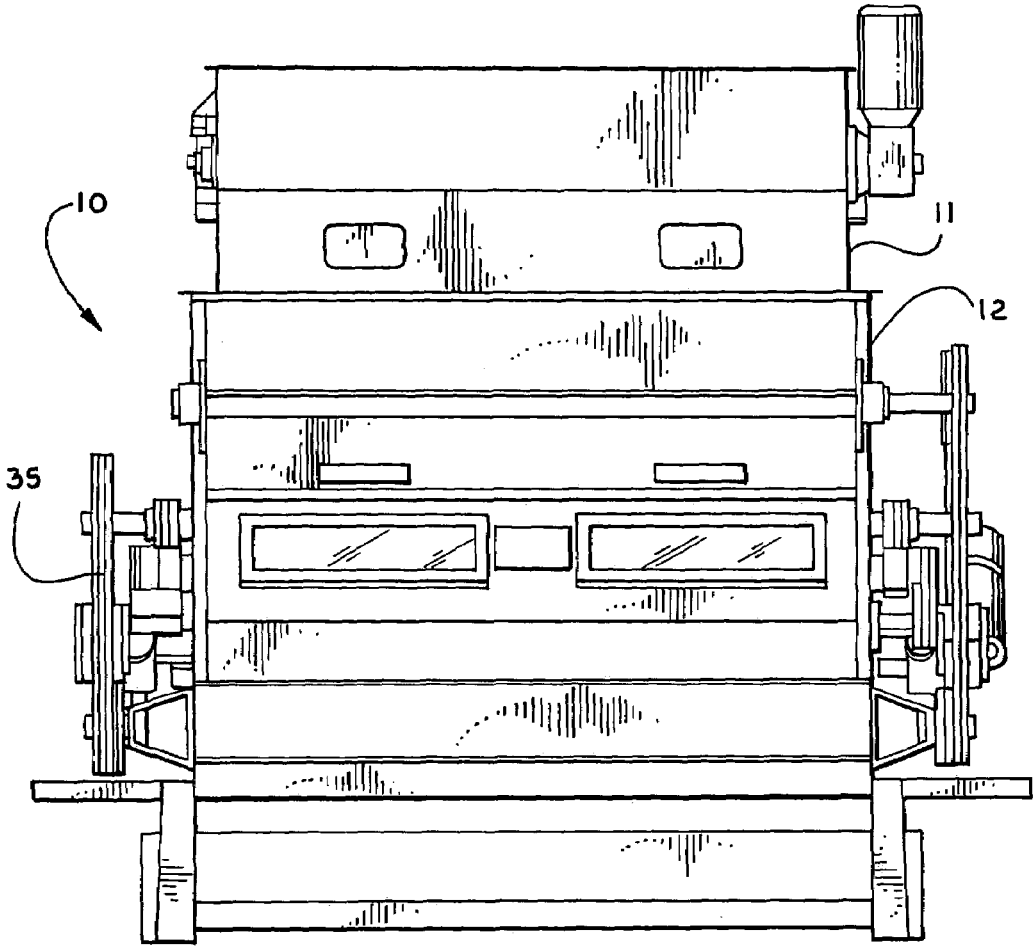
FIG. 3 is a front elevation view of the delinter
Figure 4B:
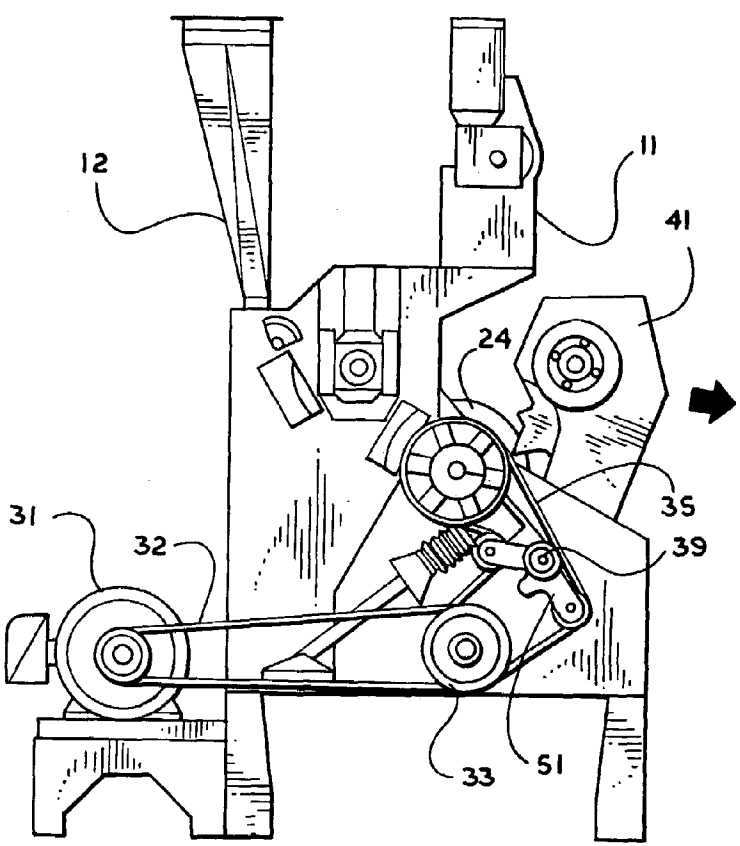
FIG. 4*a* to 4*d* are side elevation views showing the sequence of opening the gratefall and loosening the saw drive belt
Figure 4A:
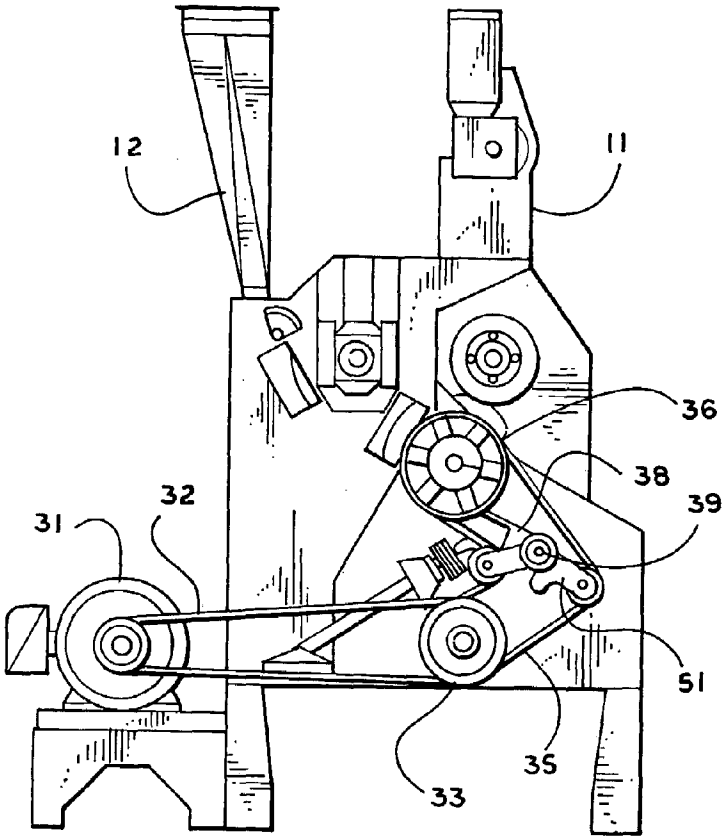
Figure 4D:
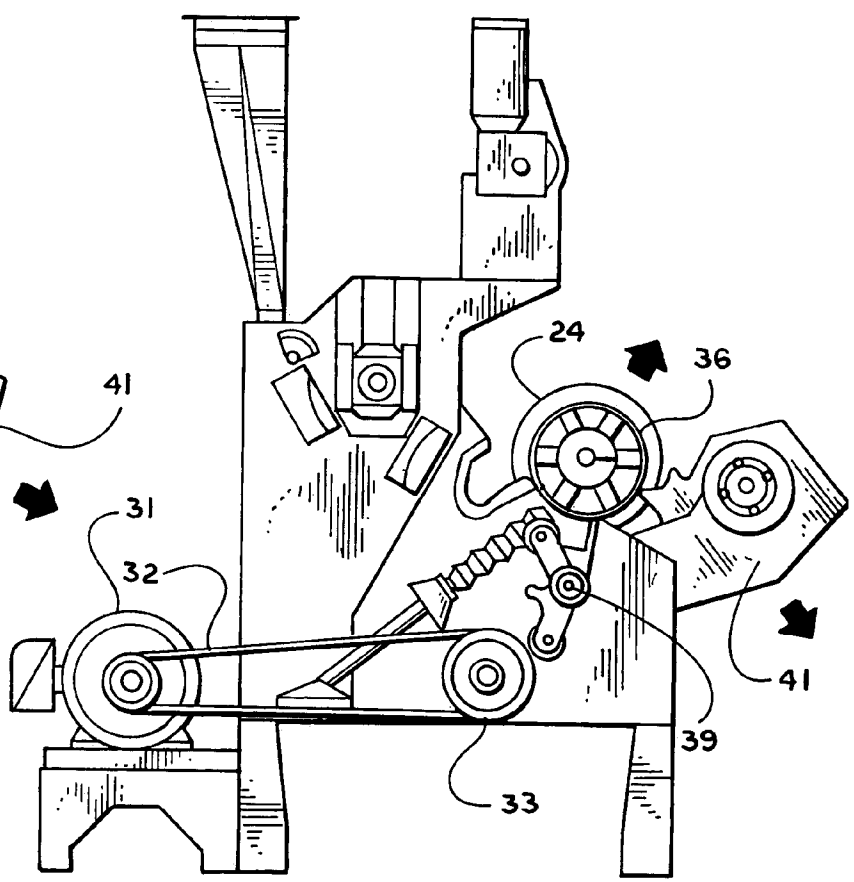
Figure 4C:
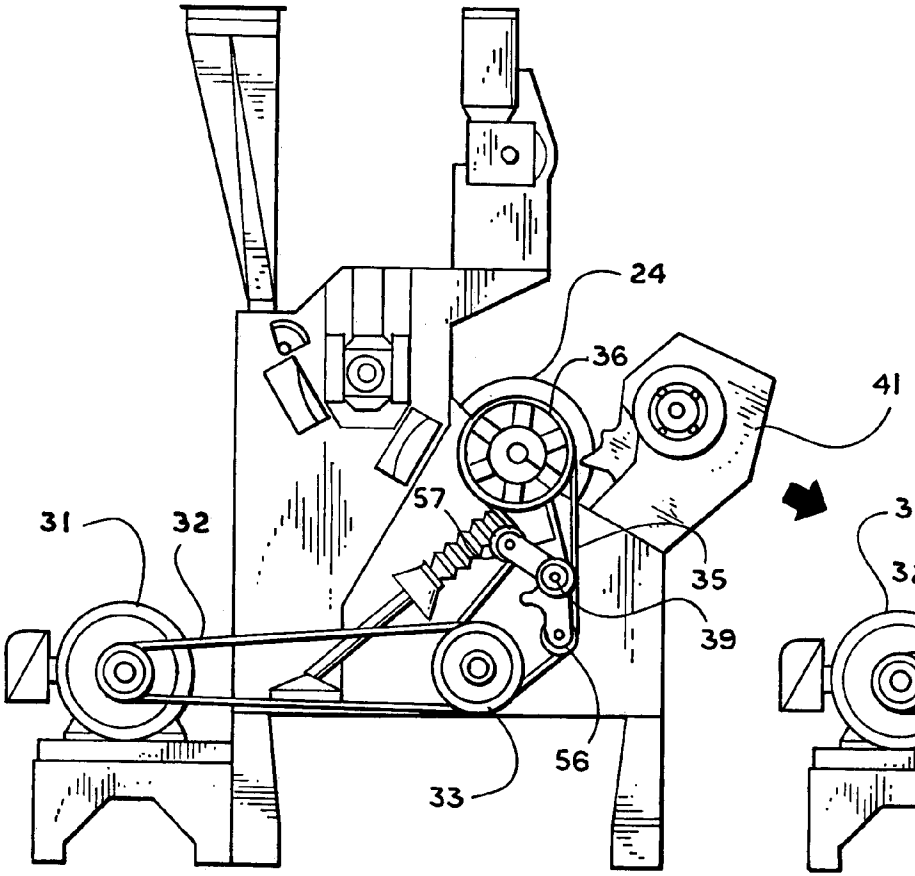

Referring to the FIGS. 1-4 for a clearer understanding of the invention, it may be seen that the preferred embodiment of the invention contemplates a delinter 10 having the same major components as the delinter shown in the '448 patent, namely a feeder 11, a lint discharge 12, a motes conveyor 13, a seed conveyor 14, a housing 20, including various access doors and windows. A float 16 and chamber 17 is defined beneath feeder 11 within the housing 20 and above a saw cylinder 22 which carries a plurality of saws 24. A doffing cylinder is provided to conventionally doff the lint from the saws.

In the '448 patent, the disclosed gratefall assembly supported the float and was linked to the saw cylinder supports such that opening the gratefall exposed the saw cylinder and moved it to a position where it could be hoisted vertically. However, the gratefall was moved between the open and closed positions by a hydraulic cylinder mounted outside the gratefall assembly. The drive belts for the float and the saw cylinder were tensioned by separate pneumatic cylinders. In that design the tension had to be released and the drive belts for both the float and saw removed before the gratefall could be opened. This required the operator to undertake several steps to open the gratefall including removing the belts while leaning over the motes and seed conveyors.

The present invention eliminates all hydraulic and pneumatic cylinders and releases the tension on the saw and float belts while the gratefall transitions from the closed to open position, thus eliminating several steps and allowing the operator to remove the belts as needed from the front of the machines and also eliminates or replaces other forms of removing saw cylinder. Referring to FIGS. 1 to 4 in the current design, saw motor 31 drives take-off belt 32, to sheave 33 which is mounted to housing 11 at a fixed location. A saw belt 35 is also entrained about sheave 33 and saw drive sheave 36 which is mounted on saw pivot arms 38 on each side of the delinter are pivotally rotated with gratefall assembly 41 about the same axis passing through pivot shaft 39, thus the saw drive sheave 36 is movable with the gratefall assembly 41. Mounted to the saw cylinder pivot arm 38 and pivot shaft 39, and interposed between sheave 33 and saw drive sheave 36 is the saw idler assembly 51 Saw idler assembly 51 includes a fixed idler bracket 52 pivotally mounted for movement about pivot shaft 39 in fixed relation to gratefall assembly 41 and a floating idler bracket 53 also mounted for movement about pivot shaft 39 at a selected angle offset from fixed idler bracket 52. The offset between brackets 52 and 53 is maintained by rod adjustably connected there between. Bracket 52 carries a belt idler pulley 56 which engages saw belt 35 forwardly of pivot shaft 39 and bracket 53 carries a belt idler pulley 57 which engages belt 35 rearwardly of pivot shaft 39 and serves as a tensioning pulley. The tension on the belt is adjusted by varying the angle between brackets 52 and 53. On the opposite side of the delinter 10 a float take-off belt 62 is driven by float motor 61 about a sheave 63 mounted to housing 11 at a fixed location. A float belt 65 is entrained about sheave 63 and float drive sheave 64. A float idler assembly 71 which is the mirror image of saw idler assembly 51 and includes a fixed bracket 72, floating bracket 73, positioning rod, belt idler pulley 76, and belt tensioning pulley 77 both of which engage the float belt 65 in the same manner as described above. It will be noted that pivot shaft 38 is offset from a direct line between sheaves 33, 63 and drive sheaves 36, 64, thus engagement of belts 35, 65, by the idler pulleys 56,76 and 57,77 give the belts a L shaped configuration when properly tensioned.

A pair of jack screws 81, 82 are mounted to the housing and connected to the pivot arms 38 to urge the pivot arms about the pivot axis in opening and closing the gratefall assembly 41. An electric motor 83 elongates and shortens the jack screws. When the jack screws are elongated they urge the drive sheaves 36, 64 carried by the gratefall assembly 41 away from the fixed sheaves 33, 63, thus making the L shape of the drive belts 35, 65 more obtuse as shown in FIG. 2*a* to 2*d* and moving idler pulleys 56, 76 closer to drive sheaves 33, 63 thus releasing the tension on the belts 35, 65 such that when the grate fall is completely open the saw belt 35 may be easily removed or replaced on the sheaves at a convenient level directly in front of the operator. The float belt 65 is loosened but does not need to be removed from the drive sheave to remove the saw cylinder. It should be therefore apparent that the operation of opening the gratefall and removing the saw cylinder for sharpening or maintenance is greatly simplified. Note that since the doffing roll is not mounted to the gratefall assembly 41, it does not move and doffing roll belt 92 remains tensioned between sheave 63 and doffing drive sheave 93, in as much as the float and doffing roller are driven by the same motor.

It should be noted that jackscrews 81, 82 provide a positive mechanical linkage to the gratefall assembly 41, thus if electrical power is lost during the movement of the gratefall the jackscrew will stop and the gratefall assembly will remain in its then current position rather than falling under the influence of gravity as could occur with a hydraulic system. It is also noteworthy that limit switches are in the circuit energizing saw motor 21 and float motor 61. These limit switches open when the gratefall assembly begins to move from the closed position de-energizing the saw circuit and thus insuring that none of the belts, motors or sheaves are energized during the saw cylinder change out process.

It should be noted that feeder 11 is the same width as saw cylinder 22, thus seed entering the float chamber 17 and urged toward the saws 24 is able to pass vertically through the delinter without the need to migrate laterally as was the case in the delinter shown in the '448 patent. Accordingly the seed can be processed more quickly and no build up or accumulation of seeds at any region across the saw cylinder 22 is encountered, thereby reducing the dwell time of the seed on the saws 24 and reducing the prospect of slicing the seed and contaminating the lint with hull or oil produced by the machine.

Aiding in the direct processing of the seed cotton from the feeder to the saws is the redesign of the entry to the float chamber 17 in the gratefall assembly 41. The rear scroll 101 has been extended and turned nearly 90 degrees at the entrance from the feeder so that a smooth surface with no transitions between metal parts are presented except where the scroll 101 abuts frame plate 102. Likewise, the seed board 103 has been redesigned to reduce friction at the inlet from the feeder 11, by turning the upper edge of the plate forming the seed board away from the inlet, thereby eliminating a part to part transition and improving the flow characteristics of the cotton seed.

Figures 5, 6:
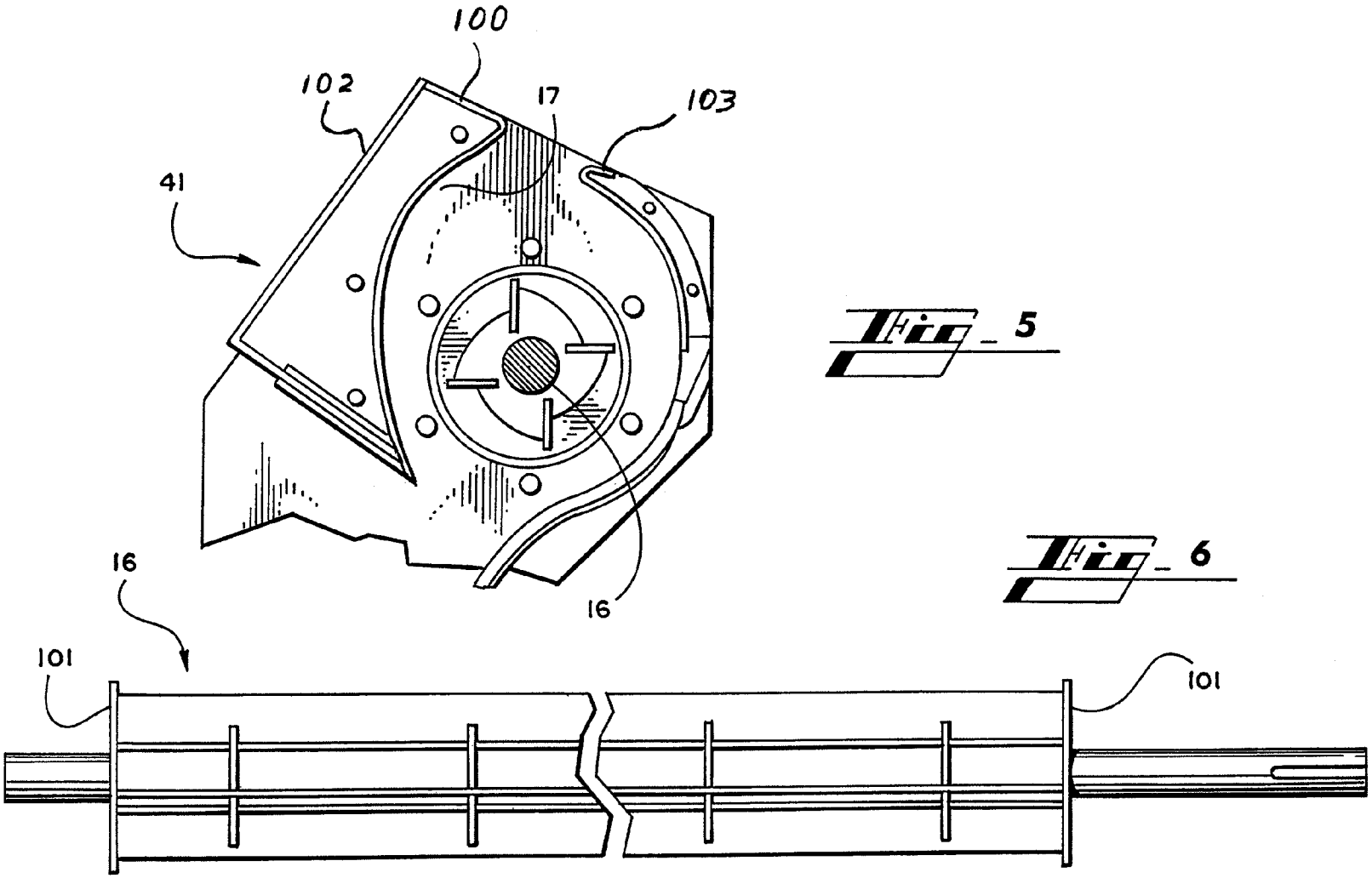
FIG. 5 is a detail of the transition from the feeder to the gratefall
FIG. 6 is a detail of the float assembly.

A further refinement in flow is achieved by adding end caps 101 to the float which rotate with the float vanes as seen in FIG. 6. Traditional floats did not have endcaps thus creating friction and accumulation of cottonseed at the float vane and gratefall sideplate interface which exerts extra pressure against the gratefall side plates and forces most of the seed to be discharged at each end of the float chamber causing uneven delinting of the seed. By improving the flow of the cottonseed from the wider feeder through the smother entrance and across the more efficient float, the quality of the lint produced by the machine and the efficiency of the delinter is greatly improved. This is particularly so, when the saws 24 themselves are configured differently. More specifically, prior to the introduction of the '448 delinter the saw teeth were formed with a tangent line intersecting a 12" diameter saw. The '448 design used an 18" diameter saw with a tangent designed for that saw diameter, however, this saw tooth design was more likely to rip the seed hull. Thus, some prior art machines were retrofitted with 18" diameter saws in on which the tangent line of the tooth was the same as had been used on a 12" diameter saw. This reduced the damage to the hull considerably, but did not provide the efficient operation and significantly improved quality lint which is achieved when the feeder is widened, the float capped and the transition from feeder to gratefall is smoothed in addition to using the 12" tangent line tooth on an 18" saw.

It is to be understood that the form of the invention shown is a preferred embodiment thereof and that various changes and modifications may be made therein without departing from the spirit of the invention or scope as defined in the following claims.

What is claimed is:

1. An improved apparatus for removing lint from cottonseed that has had staple fiber previously removed by ginning including a feeder, a driven float, a driven saw cylinder, a gratefall selectively moveable about a pivot axis to an open or closed position to allow access to said saw cylinder and a frame supporting said gratefall and said feeder, wherein the improvement comprises:

a. at least one actuator operatively connected to said gratefall to selectively urge said gratefall to said open or closed position;

b. at least one idler assembly operatively connected to said gratefall for concomitant motion therewith about said pivot axis, such that said idler assembly engages a drive belt for said driven saw cylinder to selectively tension said drive belt in said closed position or loosen said drive belt as said gratefall moves toward said open position.

2. The improvement as defined in claim 1 wherein said at least one actuator comprises a screw actuator connected between said frame and said gratefall for selective elongation and shortening to move said gratefall about said pivot axis.

3. The improvement as described in claim 1 further comprising, a first sheave mounted to said frame at a fixed location, a saw drive sheave mounted to said saw cylinder for concomitant motion with said gratefall about said pivot axis, wherein said drive belt is entrained about said drive sheave, said first sheave, and said idler assembly such that said drive belt is removable when said gratefall is in said open position.

4. The improvement as defined in claim 3 further comprising a float drive belt, a float drive sheave connected to said float, a second sheave mounted to said frame at a fixed location, and a float idler assembly mounted intermediate said second sheave and said float drive sheave for concomitant pivotal motion with said gratefall and engaging said float drive belt to tension said belt when said gratefall is in a closed position and to release said tension when the gratefall is opened.

5. The improvement as defined in claim 4 wherein said at least one actuator comprises a screw actuator connected between said frame and said gratefall for selective elongation and shortening to move said gratefall about said pivot axis.

6. The improvement as defined in claim 4 further comprising an electrically actuated saw motor providing motive force to said saw cylinder, an electrically actuated float motor providing motive force to said float, and sensors connected to said gratefall and electrically connected to said saw motor to prevent operation of said saw motor with said gratefall in any open position.

7. The improvement as defined in claim 3 wherein said idler assembly comprises a fixed idler bracket connected to said gratefall for concomitant movement about said pivot axis with said gratefall, an idler pulley mounted to said fixed idler bracket for rotation thereon in engagement with said drive belt, a variable idler bracket mounted to said gratefall forming selected obtuse angle with said fixed idler bracket for concomitant motion therewith about said pivot axis, a second idler pulley mounted to said variable idler bracket for rotations thereon in engagement with said drive belt, wherein the angle between said fixed bracket and said variable bracket is adjusted to set the tension in said drive belt, and wherein movement of said idler assembly about said pivot axis with said gratefall tensions and releases the tension in said drive belt.

8. The improvement as defined in claim 1 wherein said saw cylinder has an operative length over which a plurality of saws are spaced and said feeder and float have an axial dimension substantially equal to said operative length such that cottonseed passing through said apparatus are subject to minimal movement parallel to the axis of said saw cylinder.

9. An improved apparatus for removing lint from cottonseed that has had staple fiber previously removed by ginning including a feeder, a driven float, a driven saw cylinder having an operative length over which individual saws are spaced, a gratefall selectively moveable about a pivot axis to an open or closed position to allow access to said saw cylinder and a frame supporting said gratefall and said feeder, wherein the improvement comprises:

a. at least one actuator operatively connected to said gratefall to selectively urge said gratefall to said open or closed position;

b. a float chamber formed within said gratefall substantially as wide as the operative length of said saw cylinder, said float chamber having an inlet defined in part by a front seed board and a rear seed scroll wherein said seed board and seed scroll form arcuate reduced drag surfaces at said inlet, with said feeder having an outlet width equal to said saw cylinder such that lateral movement of seed through said float cylinder and saw is diminished, c. float end caps mounted to opposite ends of said driven float and rotatable therewith, said feeder, float, and saw cylinder operative length being substantially uniform in axial length.

10. In an apparatus for delinting cottonseed having a driven saw cylinder, a feeder for directing cottonseed to said saw cylinder, a housing defining a flow path for said cottonseed from said feeder past said saw cylinder and a gratefall, forming a part of said housing and defining a part of said path, movably mounted to said housing for selectively accessing said saw cylinder, the improvement comprising:

a. an actuator for selectively moving said gratefall between an open position providing access to said saw cylinder and a closed position wherein said portion of said part of said path is aligned with said feeder and saw cylinder;

b. an idler assembly mounted for concomitant motion with said gratefall such that said idler tensions a drive belt associated with said driven saw cylinder when said gratefall is in said closed position and releases all tension on said drive belt when said gratefall is in said open position.

11. The improvement as defined in claim 10 wherein said drive belt is driven by an electric drive motor and said actuator is driven by an electric actuator motor and wherein sensors are mounted relative to said gratefall and housing to interrupt electrical power to said drive motor when said gratefall is not in said closed position.

12. The improvement as defined in claim 10 wherein said actuator is a mechanical screw actuator providing support to said gratefall at any position between said closed position and said open position.

13. The improvement as defined in claim 10 wherein said gratefall supports a driven float assembly within said part of said path, partially defining a float chamber, and further comprising a second idler assembly mounted for concomitant movement with said gratefall such that said idler tensions a drive belt associated with said driven float assembly when said gratefall is in said closed position and releases all tension on said drive belt when said gratefall is in said open position.

* * * * *